US005743674A

United States Patent [19]

Healy

[11] Patent Number: 5,743,674

[45] Date of Patent: Apr. 28, 1998

[54] ABSORBENT BERM DEVICE

[75] Inventor: Patrick E. Healy, Gallitzin, Pa.

[73] Assignee: New Pig Corporation, Tipton, Pa.

[21] Appl. No.: 711,585

[22] Filed: Sep. 10, 1996

[51] Int. Cl.[6] ..... B01D 63/06

[52] U.S. Cl. ..... 405/52; 210/321.73

[58] Field of Search ..... 405/52, 60, 63; 210/321.73, 321.79, 321.8

[56] References Cited

U.S. PATENT DOCUMENTS

| | | | |
|---|---|---|---|
| 1,742,369 | 1/1930 | Probst et al. | 405/114 |
| 3,568,453 | 3/1971 | Ziegenmeyer | 405/36 |
| 3,847,722 | 11/1974 | Kistner | 428/76 |
| 4,031,676 | 6/1977 | Dally | 52/102 |
| 4,659,478 | 4/1987 | Stapelfeld et al. | 210/690 |
| 4,692,060 | 9/1987 | Jackson, III | 405/115 |
| 4,752,393 | 6/1988 | Meyers | 405/63 X |
| 4,765,755 | 8/1988 | Kroger | 384/126 |
| 4,792,399 | 12/1988 | Haney et al. | 210/484 |
| 4,799,821 | 1/1989 | Brodersen | 405/115 |
| 4,813,811 | 3/1989 | Adams | 404/15 |
| 4,921,373 | 5/1990 | Coffey | 405/115 |
| 4,981,391 | 1/1991 | Klementovich | 405/52 |
| 4,988,234 | 1/1991 | Henkel et al. | 405/36 |
| 5,030,031 | 7/1991 | Brown | 405/36 |
| 5,059,065 | 10/1991 | Doolaege | 405/115 |
| 5,160,432 | 11/1992 | Gattuso | 405/63 X |
| 5,236,281 | 8/1993 | Middleton | 405/114 |

FOREIGN PATENT DOCUMENTS

| | | |
|---|---|---|
| WO 94/16974 | 8/1994 | WIPO . |
| WO 96/27710 | 9/1996 | WIPO . |
| WO 97/01003 | 1/1997 | WIPO . |

*Primary Examiner*—Tamara L. Graysay
*Assistant Examiner*—Tara L. Mayo
*Attorney, Agent, or Firm*—Buchanan Ingersoll, P.C.

[57] ABSTRACT

A device for building a berm to contain and absorb a leak or spill has a plurality of corner members each having an elongated member spaced there between. The elongated members are formed from a pliable strip having a vinyl housing. The housing has a hollow center provided longitudinally therein which is filled with an absorbent material such as an absorbent sock or mat. Openings are provided in the elongated members along the side of the housing nearer the spill or leak. The elongated members are sized and cut at the workplace to form a berm of sufficient size to meet the present spill containment problem. Once the side members and corner members have been selected and arranged, they are secured to the building floor by a caulking compound. Strapping material can then be applied, if necessary, to seal the joints between the corner members and the side members of the berm.

8 Claims, 3 Drawing Sheets

ABSORBENT BERM DEVICE

BACKGROUND OF THE INVENTION

1. Field of the Invention

This invention is related to devices for controlling fluid flow and, more particularly, to permanent or temporary berm devices for containing and absorbing liquids.

2. Background of the Invention

Removable liquid blocking devices for use on surfaces, such as building floors are well-known in the art. U.S. Pat. No. 4,031,676 discloses a rubber water blocking device having a bottom surface with a plurality of recessed disc portions which define suction cups. The bottom is engaged on smooth surfaces to form a semi-permanent dam structure. The device may be provided in straight sections and curved sections, with the sections interlocked by a tongue and groove arrangement. This device is unduly expensive to manufacture as any mold which forms the device would have to provide several suction cups on the bottom surface. The device also suffers from reduced adaptability because it is provided in sections of predetermined length which are not easily adapted on site to conform to various sized spill areas.

U.S. Pat. No. 4,981,391 discloses an inflatable, portable dam apparatus having a tubular structure and a bottom sheet of flexible material. Inflation of the dam is unduly time consuming, especially in cases where immediate, on-site liquid control is the desired object.

Similarly, U.S. Pat. No. 5,059,065 discloses a fluid-filled damming structuring having a coupling sleeve arrangement for interconnecting and receiving adjacent ends of the damming structure. U.S. Pat. No. 3,847,722 discloses a permeable, laminated web impregnated with a urethane prepolymer to stop water leaks in small holes or crevices. The prepolymer reacts with water to form a swollen, adherent hydrogel. However, the web does not have substantial thickness so it cannot be placed on a level spill surface for controlling or containing liquids. A permeable filler material, such as wood chips, may be placed inside the web, but this is impractical for on-site spill control.

More recently, U.S. Pat. No. 5,236,281 discloses a dike for damming or diverting liquids in which an elongated, pliable dike is provided in which the exterior surface is of a tacky nature. The dike is readily pliable to conform to various damming configurations. Portions of this dike may be severed on site by the user, without special tools, to tailor the dike for specific damming needs. The tacky nature of the exposed surface provides both the desired damming structure and the adherence necessary to secure the dike on a spill surface and create a proper seal. Although this dike provides an excellent temporary damming device, it is not readily adapted for permanent diking purposes.

The barriers discussed above all share the property of containing spills. None of the barriers, however, is capable of absorbing a spill that is also being contained. The ability of a barrier to both contain a spill and absorb the contents of a spill is able to contain more liquid than an ordinary barrier and lessens the amount of the spill that needs to be cleaned.

Accordingly, it is an object of the present invention to provide a device for forming a temporary or permanent berm for containing and absorbing liquids on spill surfaces, such as building floors. It is a further object to provide a device which may be easily conformed and tailored to meet a variety of configurations. It is still a further object to provide a device which can form a permanent seal but is nevertheless removable with a minimum of effort.

SUMMARY OF THE INVENTION

A device for forming a temporary or permanent berm to contain and absorb a spill or leak is provided. The device includes a plurality of elongated members formed from a housing that is perforated on the spill side only. The elongated members are adapted to contain an absorbent material such as an absorbent sock commonly used in industry. Preferably, the housing is a vinyl or polyurethane material having slots or other perforations provided on one side thereof. Alternatively, the housing may be formed from an extruded plastic material or other rigid material.

Preferably, the housing is formed in two sections which can open up longitudinally to provide a mechanism for adding and removing the absorbent material. The absorbent may be provided loosely within the interior of the housing or may be provided in a sock as shown in U.S. Pat. No. 4,659,478. By using an absorbent sock, the absorbent can be easily inserted into the interior of the housing and can be removed from the housing and replaced when fully saturated.

The device further includes a plurality of joint members which are adapted to connect a pair of the elongated members. The joint members are provided with a defined angle and serve as corners of the berm. The ends of the joint members conform in geometry to the ends of the elongated members.

When the elongated members and joint members are selected, they can be secured to the floor surrounding the spill or leak by means of a sealant such as caulk. Such sealant can also be formed from silicone, polyurethane or other material which secures the housing to the floor. Once the berm has been constructed, strapping material may be provided to cover any exposed areas of the berm assembly.

One of the advantages of the present invention is that the elongated members can be cut from a longer strip of elongated material at the work site in order to construct a berm having the desired dimensions. The ability to cut the elongated members to size affords an added degree of flexibility which allows the berm of the present invention to be used for any number of configurations.

DETAILED DESCRIPTION OF THE PREFERRED EMBODIMENTS

Figure 1:
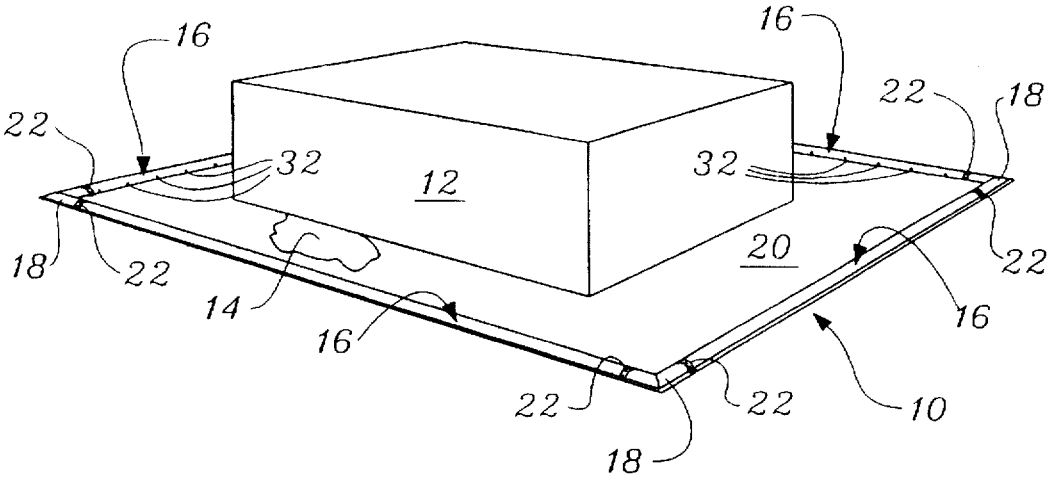
FIG. 1 is a perspective view of a presently-preferred embodiment of a berm in accordance with the present invention.

FIG. 1 shows a berm 10 which surrounds machinery 12 and spill or leak 14. Alternatively, berm 10 can be constructed around a spill or leak 14 with or without the presence of machinery 12.

As shown in FIG. 1, berm 10 can be formed in the shape of a rectangle surrounding spill or leak 14. In this arrangement, berm 10 includes four elongated members 16 which define the four sides of the rectangular berm 10. Joint members 18 are provided at each of the corners of berm 10. Elongated members 16 and joint members 18 are brought into final position and are secured to the floor 20 by means of a caulking compound. Strapping material 22 can be cut to size to cover the boundary of joint member 18 and elongated member 16. Joint members 18 may be provided in right-angle configuration as shown herein in which case a rectangular berm 10 is formed. Alternatively, joint members 18 can be provided in other configurations to provide a triangular-shaped berm, a pentagonal-shaped berm, or other multiple-sided berm. Joint members 18 can also be configured to provide a berm 10 in the shape of a parallelogram or rhombus or other geometric configuration.

Figure 2:
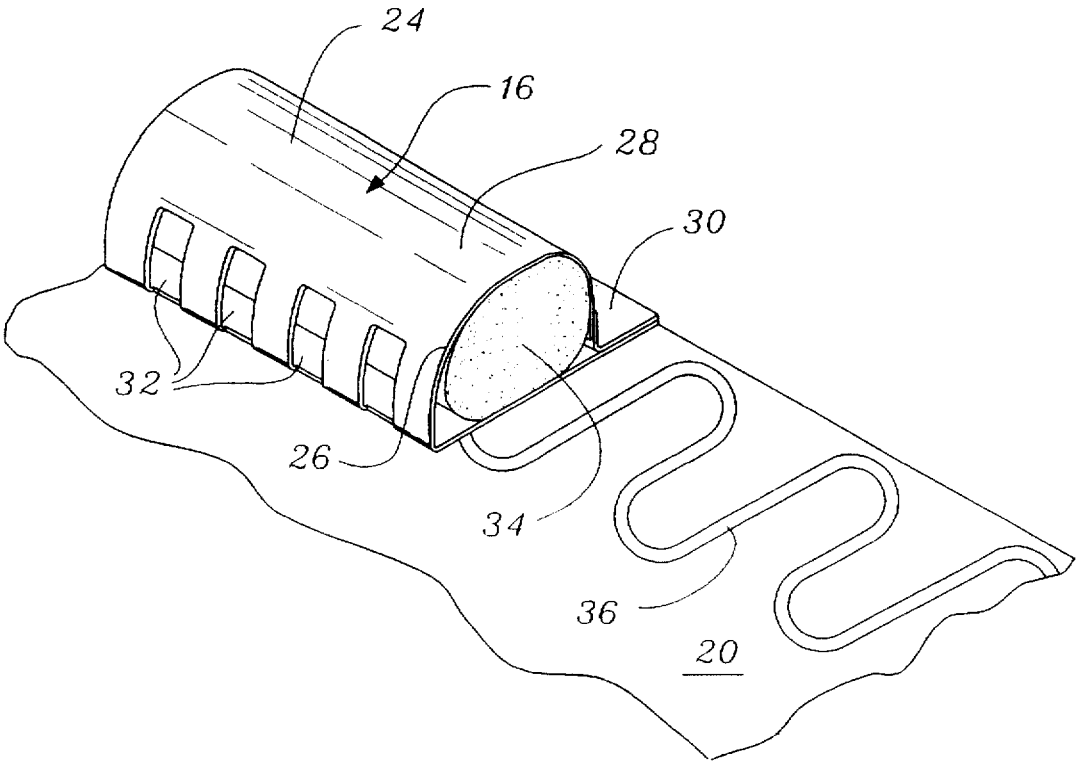
FIG. 2 is an enlarged view of the berm of FIG. 1 looking outward from within the contained space.
Figure 3:
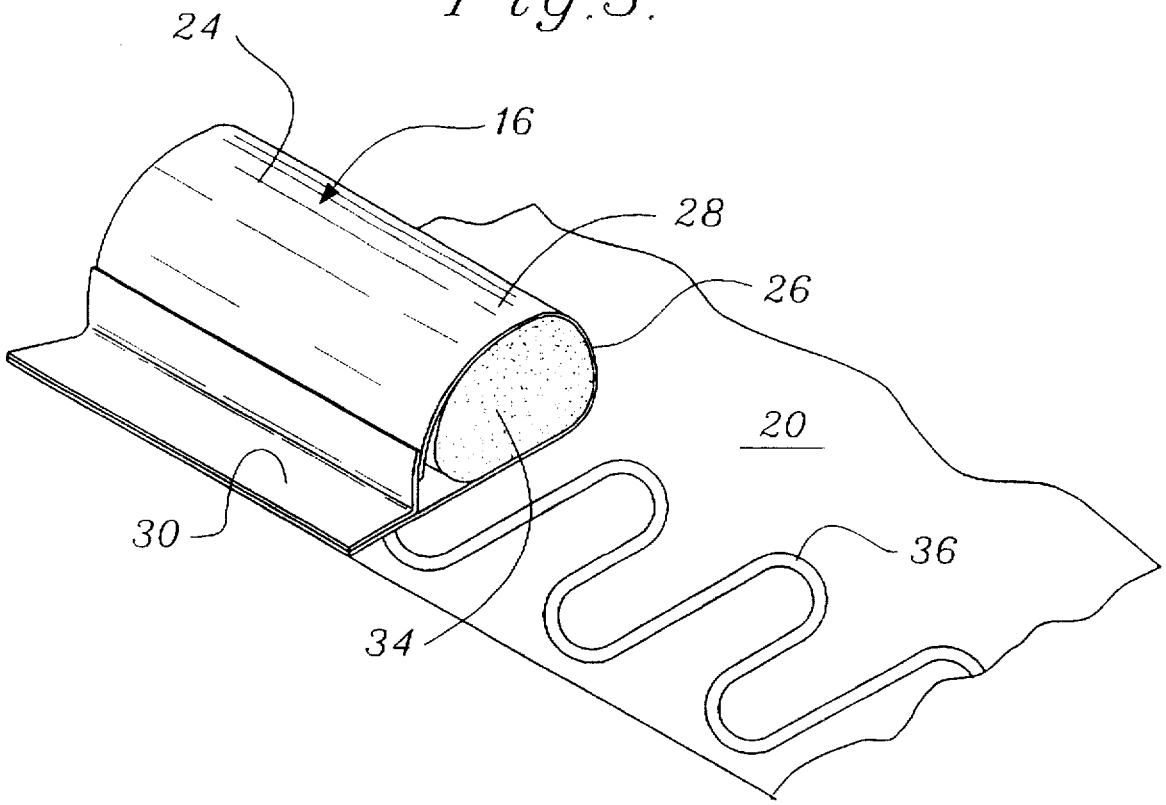
FIG. 3 is an enlarged view of the berm of FIG. 1 looking inward from outside the contained space.

FIGS. 2 and 3 are enlarged fragment views of berm 10 which illustrate the manner in which the components of berm 10 are secured together. As shown in FIGS. 2 and 3, elongated member 16 is formed from housing 24 longitudinally surrounding a center portion 26 which is filled with an absorbent material. Preferably, housing member 24 is formed in two pieces having a flap member which almost completely surrounds center 26 and a locking member 30 for securing housing 24 in a closed condition. Flap member 28 includes slots 32 or other perforations which extend along one side thereof and permit access from outside the housing 24 to the center 26.

Preferably, center 26 is filled with a material 34 designed to absorb the spill or leak 14. If desired, the absorbent 34 can be provided in a loose form within the center 26. Preferably, the absorbent 34 is provided in a sock or other container as disclosed in U.S. Pat. No. 4,659,478.

Caulking compound 36 provided on floor 20 adheres a bottom surface of flap member 28 and secures berm 10 to floor 20.

Figure 4:
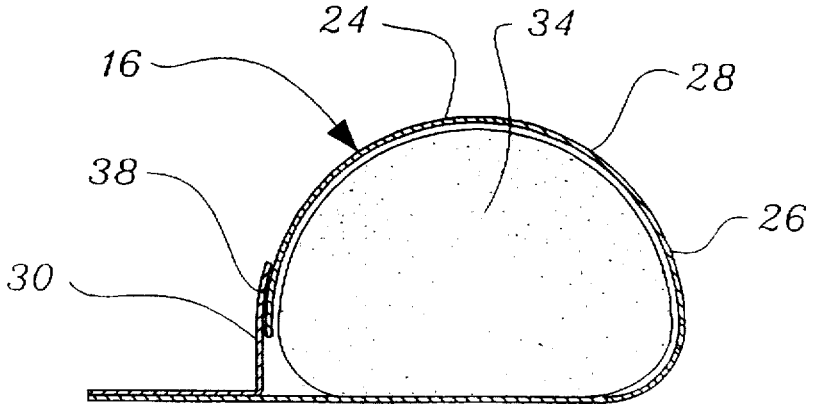
FIG. 4 is a is a transverse sectional view of the berm of FIG. 1.

FIG. 4 shows a transverse sectional view of elongated member 16 of berm 10. As shown in FIG. 4, housing 24 can be opened to provide a means for inserting absorbent 34 therein. As shown in FIG. 4, flap member 28 and locking member 30 of housing 24 are provided with corresponding hook-and-loop-type fasteners 36 which secure flap member 28 and locking member 30 together. Alternative securing means such as snaps, buttons, ties or zippers can also be used in place of, or in addition to, fasteners 38.

Figure 5:
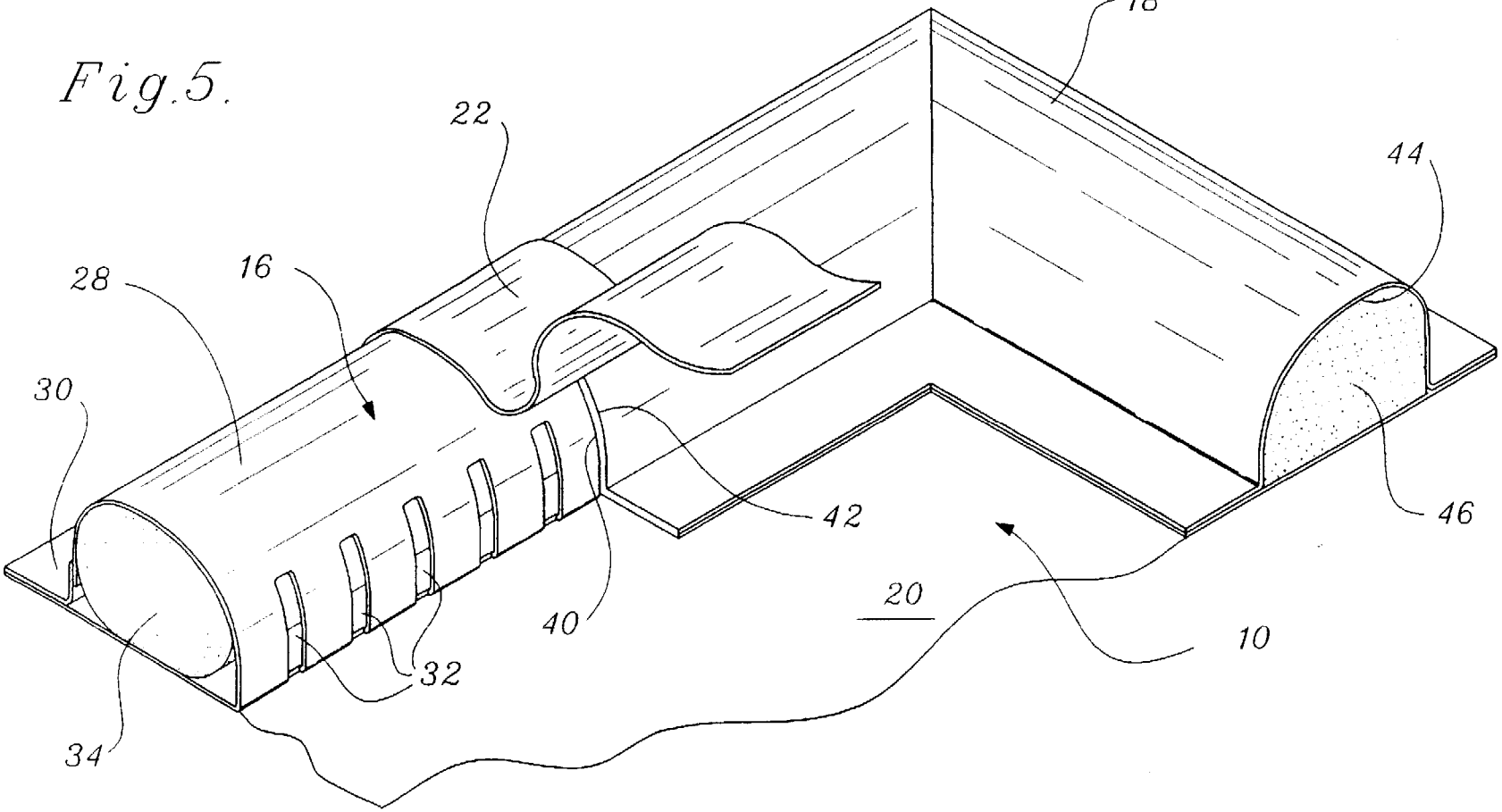
FIG. 5 is a perspective view of a corner of the berm of FIG. 1 showing the strapping sealing means.

FIG. 5 is a close-up of a corner of the berm 10 of the present invention. Therein, end 40 of elongated member 16 and end 42 of joint member 18 are brought into close contact.

Elongated member 16 and joint member 18 are then secured to the floor 20. Strapping material 22 covers the junction of elongated members 16 and joint members 18 to provide a complete seal to berm 10 and to allow berm 10 to completely contain any liquid spilled within the inner perimeter thereof.

Preferably, the center 44 of joint member 18 is filled with foam 46. However, any flexible, pliable material can be used as the filler including cellulose, and synthetic or mineral materials. Preferably, the foam is an extruded, closed-sealed polyolefin. The criteria for selecting the polyolefin material is that the material must have a shape retention property such that when compressed, the foam material returns to generally its original shape.

Preferably, housing 24 is made from vinyl. Alternatively, housing 24 may be formed from an extruded plastic material or other rigid material. In addition to vinyl, housing 24 can also be formed from polyurethane or polyols. If made from vinyl, housing 24 is preferably made from vinyl having a density of 18 oz/yd$^2$.

Because of the pliability of elongated member 16, the berm device of the present invention can be provided in a kit that includes at least one coil of elongated member 16, at least four right-angled joint members 18, a sheet of vinyl strapping 22, and caulking compound 34. Preferably, the caulking compound used in the present invention is Dow Corning silicone. However, other caulking type sealant such as polyurethane can be used in the present invention. The caulking compound, as well as the vinyl compound used in the outer housing of the elongated member 16 and in joint member 18 and vinyl strapping 22 must be selected based on resistance to chemicals to be encountered in the workplace.

In use, the coils of elongated members 16 can be cut with a sharp object such as scissors or a utility knife to a desired length. Elongated members 16 are positioned around the machinery 12 or spill 14 such that slots 32 face the source of any spill. Joint members 18 are then set against the cut elongated members 16 to allow for a custom fit of a specific containment area. Once the proper configuration of berm 10 is achieved, the silicone sealant 36 is applied to the floor 20 within the width of the elongated members 16 and joint members 18 either in a straight parallel line or in a pattern to ensure proper sealing of elongated members 16 and joint members 18 to the floor. The elongated members 16 and joint members 18 are pressed into place to make proper contact. The strapping material 22 can be cut into desired length to cover any areas that were exposed during cutting of the ends of the elongated members 16. The strapping material 22 is applied to the elongated members 16 and joint members 18 by means of standard strapping glue. After the berm 10 has been installed, housing 24 is opened and absorbent 34 is placed therein. The housing flap member 28 is tucked inside locking member 30 and fasteners 38 are applied where needed to ensure proper protection of the absorbent 34.

Absorbent 34 provided in center 26 can be easily replaced by releasing fasteners 38, thereby opening housing 24. Replacement absorbents in the nature of absorbent socks or mats can be inserted into housing 24 when an existing absorbent is fully saturated. The nature of the absorbent 34 used in berm 10 should be selected based upon the type of spill or leak 14 to be contained.

In the foregoing specification certain preferred practices and embodiments of this invention have been set out, however, it will be understood that the invention may be otherwise embodied within the scope of the following claims.

We claim:

1. A device for forming a temporary or permanent berm to contain and absorb a spill or leak comprising:

a plurality of elongated members having a housing, said housing having a hollow center provided longitudinally therein, said hollow center of at least one of said plurality of elongated members being filled with an absorbent material, each of said at least one of said plurality of elongated members having at least one opening provided in said housing along a side of said housing nearer said spill or leak, each of said plurality of elongated members having an exposed bottom surface and a pair of ends;

a plurality of joint members adapted to connect a pair of said elongated members, each of said plurality of joint members having a pair of ends generally conforming to each of said pair of ends of each of said plurality of elongated members and an exposed bottom surface;

wherein said plurality of elongated members and said plurality of joint members are connected to form a berm which surrounds said spill or leak, a bottom exposed surface of each said plurality of elongated members and each said plurality of joint members being secured to the floor surrounding said spill or leak.

2. The device of claim 1 wherein said absorbent material is at least one of an absorbent sock and mat.

3. The device of claim 2 wherein said housing is formed from a pair of flaps which are fastened together to surround said absorbent material and are unfastened to insert or remove said absorbent material.

4. The device of claim 3 wherein said housing is formed from one of polyurethane and vinyl.

5. The device of claim 4 wherein said exposed bottom surface of each of said plurality of elongated members and said plurality of joint members is secured to said floor by a sealant.

6. The device of claim 5 wherein said sealant is selected from the group consisting of silicone and polyurethane.

7. The device of claim 1 wherein said plurality of elongated members are cut to a desired size from a longer elongated member.

8. The device of claim 7 further comprising strapping material, said strapping material being cut into a desired length to cover any exposed areas of said berm along the boundary of said plurality of elongated members and said joint members.

* * * * *